US009096068B2

(12) United States Patent
Larrobis, Jr. et al.

(10) Patent No.: US 9,096,068 B2
(45) Date of Patent: Aug. 4, 2015

(54) FLUID CONTAINER

(75) Inventors: Michael Renejane Larrobis, Jr., Lapu-Lapu (PH); Jeffrey Grengia Abanto, Carcar (PH)

(73) Assignee: Funai Electric Co., Ltd. (JP)

( * ) Notice: Subject to any disclaimer, the term of this patent is extended or adjusted under 35 U.S.C. 154(b) by 0 days.

(21) Appl. No.: 13/425,695

(22) Filed: Mar. 21, 2012

(65) Prior Publication Data

US 2013/0250012 A1 Sep. 26, 2013

(51) Int. Cl.

| | |
|---|---|
| ***B41J 2/175*** | (2006.01) |
| ***B65D 25/04*** | (2006.01) |
| ***B65D 25/38*** | (2006.01) |
| ***B41J 2/19*** | (2006.01) |

(52) U.S. Cl.

CPC ..... *B41J 2/17513* (2013.01); *B41J 2/19* (2013.01); *B65D 25/04* (2013.01); *B65D 25/38* (2013.01)

(58) Field of Classification Search

CPC ..... B41J 2/175
USPC ..... 347/85, 86
See application file for complete search history.

(56) References Cited

U.S. PATENT DOCUMENTS

| | | | | |
|---|---|---|---|---|
| 5,023,629 | A * | 6/1991 | Kiyohara | 347/36 |
| 6,132,036 | A * | 10/2000 | Abe et al. | 347/86 |
| 6,270,207 | B1 * | 8/2001 | Sasaki | 347/86 |
| 6,336,719 | B1 * | 1/2002 | Ishinaga et al. | 347/86 |
| 6,874,874 | B2 * | 4/2005 | Sasaki | 347/86 |
| 7,014,304 | B2 * | 3/2006 | Sasaki | 347/86 |
| 7,210,772 | B2 * | 5/2007 | Sasaki | 347/86 |
| 7,434,922 | B2 * | 10/2008 | Sasaki | 347/86 |
| 2007/0109362 | A1 * | 5/2007 | Hori et al. | 347/65 |

* cited by examiner

*Primary Examiner* — Matthew Luu
*Assistant Examiner* — Lily Kemathe
(74) *Attorney, Agent, or Firm* — Amster, Rothstein, Ebenstein LLP

(57) ABSTRACT

A container for holding a volume of fluid includes a housing defining an interior for retaining the volume of fluid, a vent system disposed at an upper portion of the interior adjacent to a fluid chamber to vent air to atmosphere. The vent system includes an air chamber in fluid communication with the fluid chamber through an air inlet and disposed within the interior. The air chamber includes a bottom surface angling from the air inlet towards a distal end of the air chamber.

19 Claims, 6 Drawing Sheets

FLUID CONTAINER

FIELD OF THE DISCLOSURE

The present disclosure relates generally to micro-fluid applications, such as inkjet printing. The present disclosure relates particularly to a fluid container having an air chamber for venting air to atmosphere.

BACKGROUND

The art of printing images with micro-fluid technology is relatively well-known. A permanent or semi-permanent printhead has access to a local or remote supply of fluid. The fluid is usually stored in a container, such as a tank or a cartridge. In an imaging device having a local supply of fluid, the container is installed within the casing of the imaging device. FIGS. 1 and 2 depict a conventional fluid container 100 used in an imaging device. The conventional fluid container 100 includes a fluid chamber 106 defined in an interior of the housing 104 to hold a volume of fluid 102. The container 100 further includes a fluid exit port 108 for delivering fluid 102 to the imaging device. The container also include a vent 132 having at least one vent hole 118 to vent air to atmosphere and to receive air from the atmosphere as the volume of fluid 102 is depleted. As fluid 102 from the container 100 is supplied to the imaging device through a fluid exit port 108, air from the atmosphere is siphoned through the at least one vent hole 118 and into the container 100. The air occupies the volume of space left empty by the exiting fluid 102. As a result, the pressure inside the container 100 is maintained.

When the fluid container 100 is oriented at a different position, as shown in FIG. 2, with the front side 120 facing downwards or with the back side 122 substantially above the front side 120, either during actual use or during transport, fluid 102 may leak through the vent 132. The vent system may be designed to resist fluid leaks 102D at a certain fluid pressure range, but a sudden movement of the container 100 could cause a sudden rush of fluid 102 towards the vent 132 through the at least one vent hole 118 resulting to an instantaneous increase in fluid pressure P above the tolerable range, thus leading to leaking or dripping of fluid 102 at the vent 132. Fluid leaks 102D not only result to fluid waste but could also affect the operational efficiency of the imaging device when fluid 100 is trapped in the vent 132. The trapped fluid 100 may dry and could clog the at least one vent hole 118 thus obstructing the flow of air into the container 100 thereby creating a negative pressure inside the container 100. With a negative pressure inside the container 100, the flow of fluid 102 is adversely affected resulting to fluid starvation in the imaging device. Thus, it is necessary to eliminate clogging of the vent 132 caused by trapped fluid 100 brought about by instantaneous increases of fluid pressure P in the vent area during movement of the container 100.

Accordingly, a need exists in the art for a fluid container with an improved vent system.

SUMMARY

The above-mentioned and other problems become solved with a fluid container having an air chamber disposed at an upper portion of the interior adjacent to the fluid chamber that prevents instantaneous increase of fluid pressure in the vent hole area.

The air chamber forms part of the vent system, the air chamber being in fluid communication with the fluid chamber through an air inlet. The vent system serves as an ingress and egress of the air to and from the container and maintains the pressure inside the container. The air chamber has an angling bottom surface inclined towards a distal end of the air chamber. The bottom surface is configured to allow fluid in the air chamber to flow back to the fluid chamber through the air inlet thereby minimizing trapping of fluid in the vent system.

A vent hole is disposed on the distal end of the air chamber above the bottom surface. The air chamber further includes a ceiling extending from a proximate end of the air chamber towards the distal end. The distance between the ceiling and the bottom surface is lesser at the proximate end than at the distal end of the air chamber. The configuration of the ceiling in relation to the bottom surface allows less volume of fluid to flow into the air chamber when the container is oriented at different positions, either during actual use or during transport. Lesser volume of fluid inside the air chamber equates to lesser fluid pressure compared to the fluid pressure in the fluid chamber where a greater volume of ink resides. Lesser fluid pressure inside the air chamber also equates to lesser fluid pressure at the vent hole area thus minimizing, if not, eliminating fluid leaks and drippings at the vent.

The air inlet of the air chamber is disposed at a terminal end of the bottom surface near the proximate end of the air chamber. Adjacent the air inlet is a sidewall extending substantially transverse from an upper wall of the housing. The sidewall blocks the fluid and prevents the fluid from crashing directly into the air chamber towards the vent hole area when the container is moved or re-oriented during actual use or transport.

BRIEF DESCRIPTION OF THE DRAWINGS

The accompanying drawings incorporated in and forming a part of the specification, illustrate several aspects of the present disclosure, and together with the description serve to explain the principles of the present disclosure. In the drawings.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the present disclosure. It is to be understood that other embodiments may be utilized and that process, electrical, and mechanical changes, etc., may be made without departing from the scope of the present disclosure. The following detailed description, therefore, is not to be taken in a limiting sense and the scope of the present disclosure is defined only by the appended claims and their equivalents.

Figure 1:
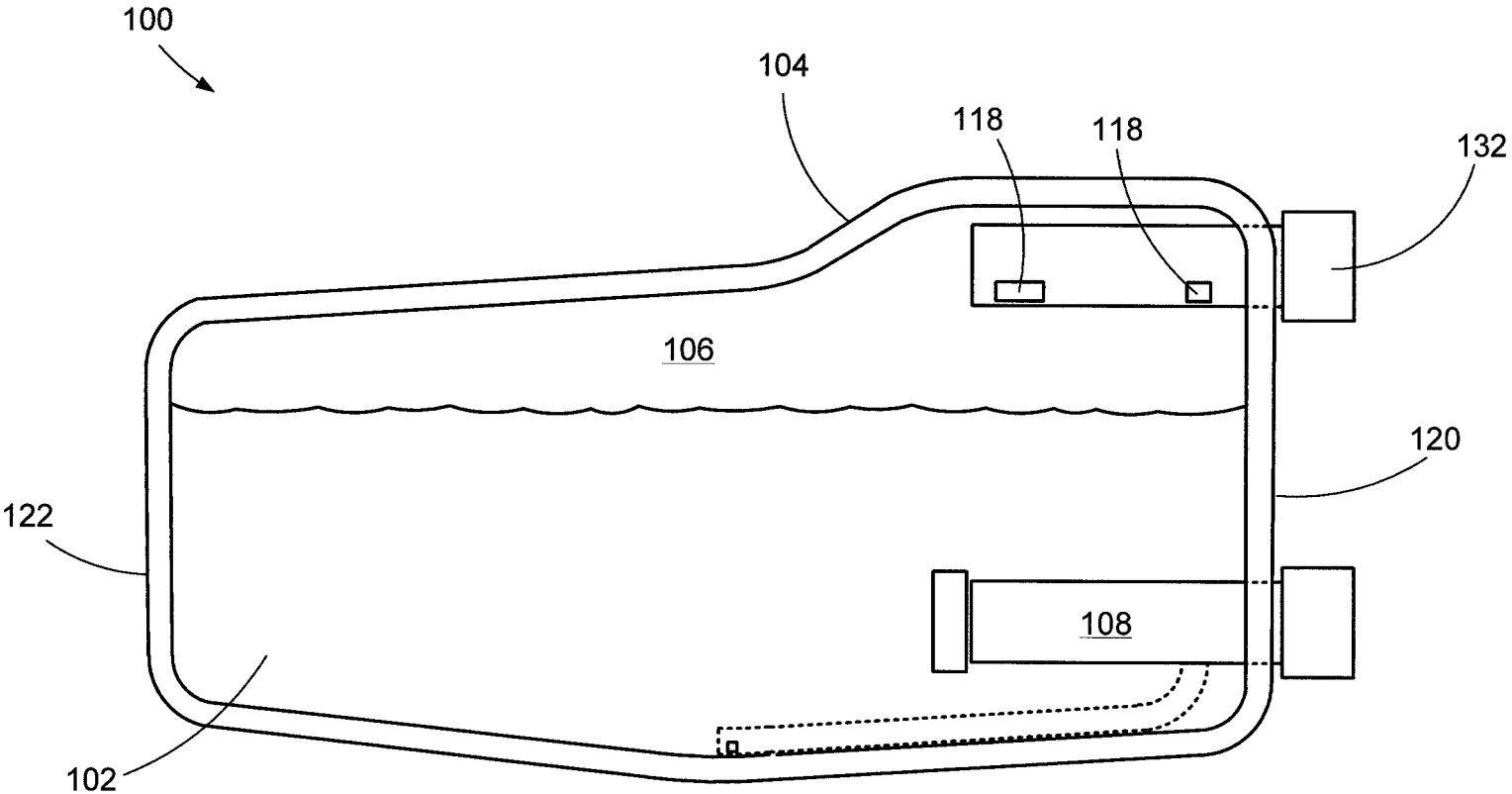
PRIOR ART Figure 1
FIG. 1 is a diagrammatic view of a conventional fluid container.
Figure 2:
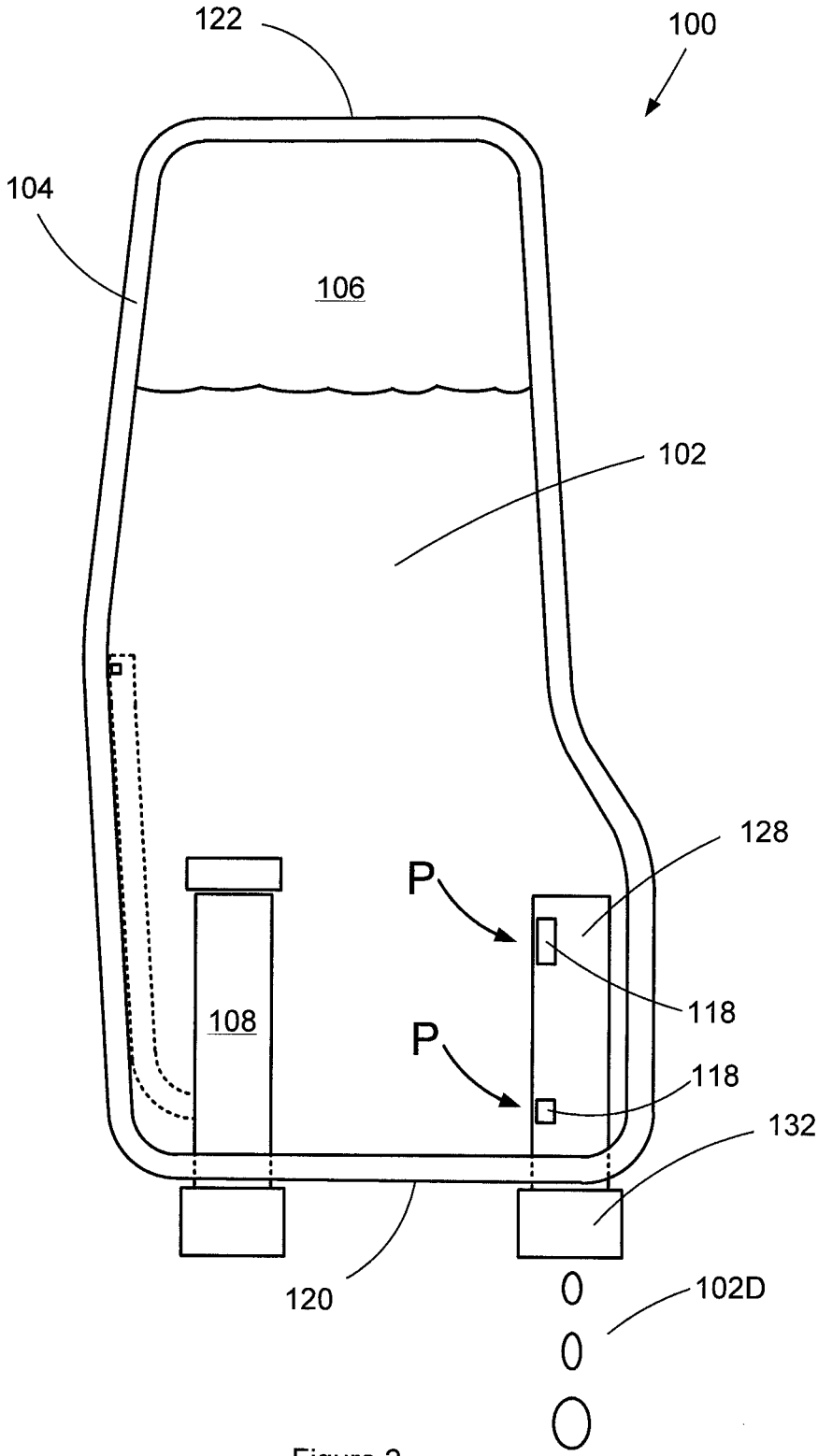
Figure 2 PRIOR ART
FIG. 2 is a diagrammatic view of a fluid container of FIG. 1 showing the fluid container oriented with the front side faced downwards.
Figure 3:
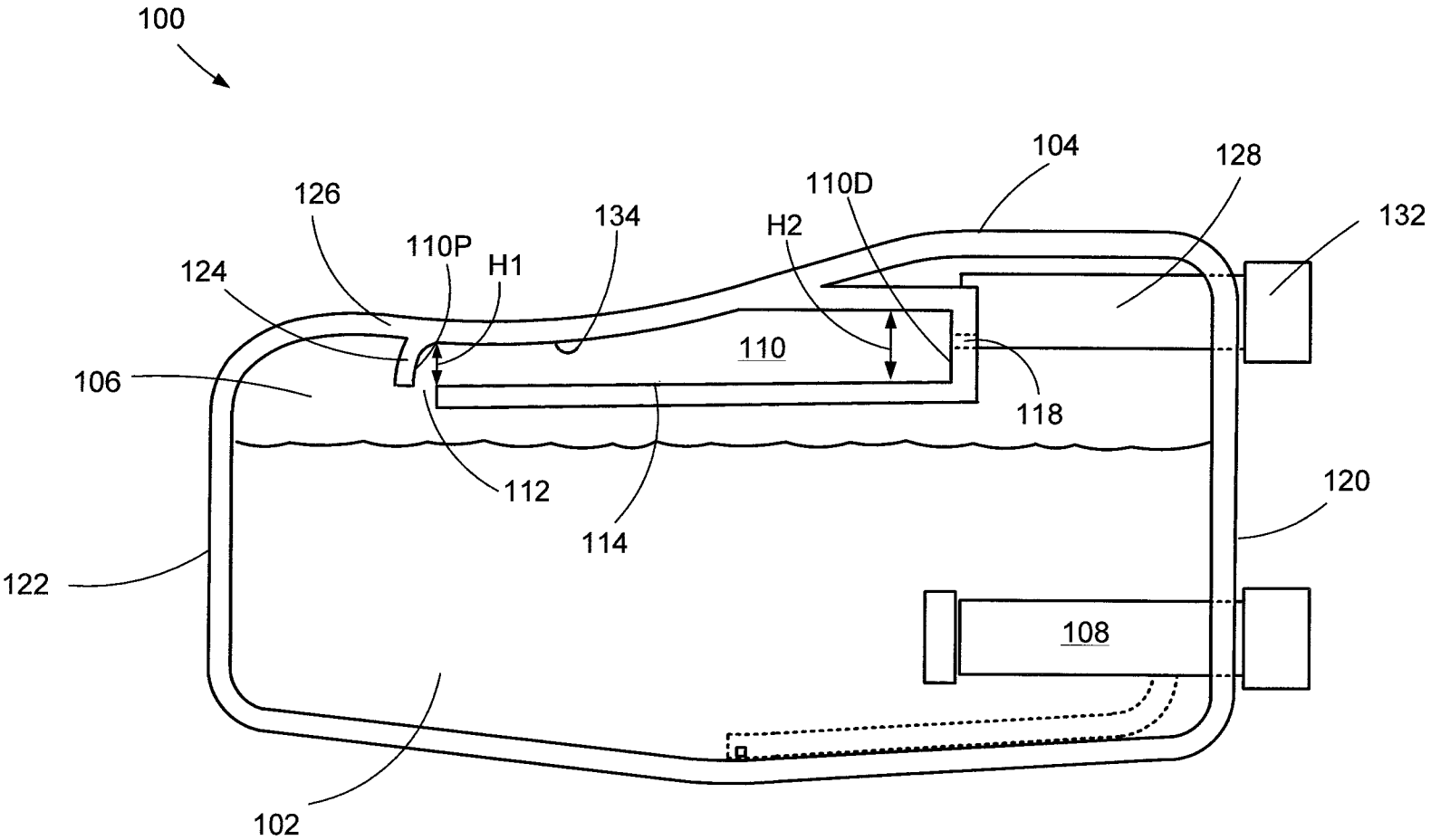
FIG. 3 is a diagrammatic view of a fluid container according to the present invention.

FIG. 3 depicts a container 100 according to the present invention. The container 100 includes a housing 104, a fluid chamber 106, a fluid exit port 108 and a vent system. The housing 104 having a front side 120 and a back side 122 defines an interior. Disposed in the interior of the housing 104 is a fluid chamber 106 for holding a volume of fluid 102. The vent system includes an air chamber 110, a vent hole 118, an air exit channel 128, and a vent 132. The vent system is disposed above the fluid chamber 106. The vent system maintains the pressure inside the container 100 by venting air to atmosphere and by also allowing a volume of air to enter the container 100 and replace the volume of fluid 102 consumed during print operation.

In a first example embodiment, the air chamber 110 includes an inclined bottom surface 114 angling from an air inlet 112 to a distal end 110D of the air chamber 110. The air inlet 112 is disposed in a terminal end of the bottom surface 114 near a proximate end 110P of the air chamber 110.

In a second example embodiment, the bottom surface 114 inclines towards the distal end 110D at an angle of about 2 degrees to about 7 degrees. When the fluid container 100 is oriented as in FIG. 3, the inclined bottom surface 114 allows fluid 102 in the air chamber 110 to flow downward, by gravity, from the distal end 110D to the proximate end 110P to minimize trapping of fluid 102 in the vent system. Without any trapped fluid 102, clogging due to presence of dried fluid 102 is minimized if not eliminated.

In a third example embodiment, the air chamber 110 includes a ceiling 134 extending from the proximate end towards the distal end of the air chamber. The distance H1 between the ceiling 134 and the bottom surface 114 is lesser at the proximate end 110P than the distance H2 between the ceiling 134 and the bottom surface 114 at the distal end of the air chamber 110. The configuration of the ceiling 134 in relation to the bottom surface 114 allows less volume of fluid 102 to flow into the air chamber 110 when the container 100 is oriented at different positions, either during actual use or during transport as will be shown in detail later in FIG. 4.

In a fourth example embodiment, the air chamber 110 is disposed at a distance D1 from a back side 122 of the housing 104, as will be shown in detail later in FIG. 5. The container 100 includes a sidewall 124 extending substantially transverse from an upper wall 126 of the housing 104 and at a distance D1 from the back side 122 to block and prevent the fluid 102 from rushing towards the air chamber 110 during movement and re-orientation of the container 100.

Figure 4:
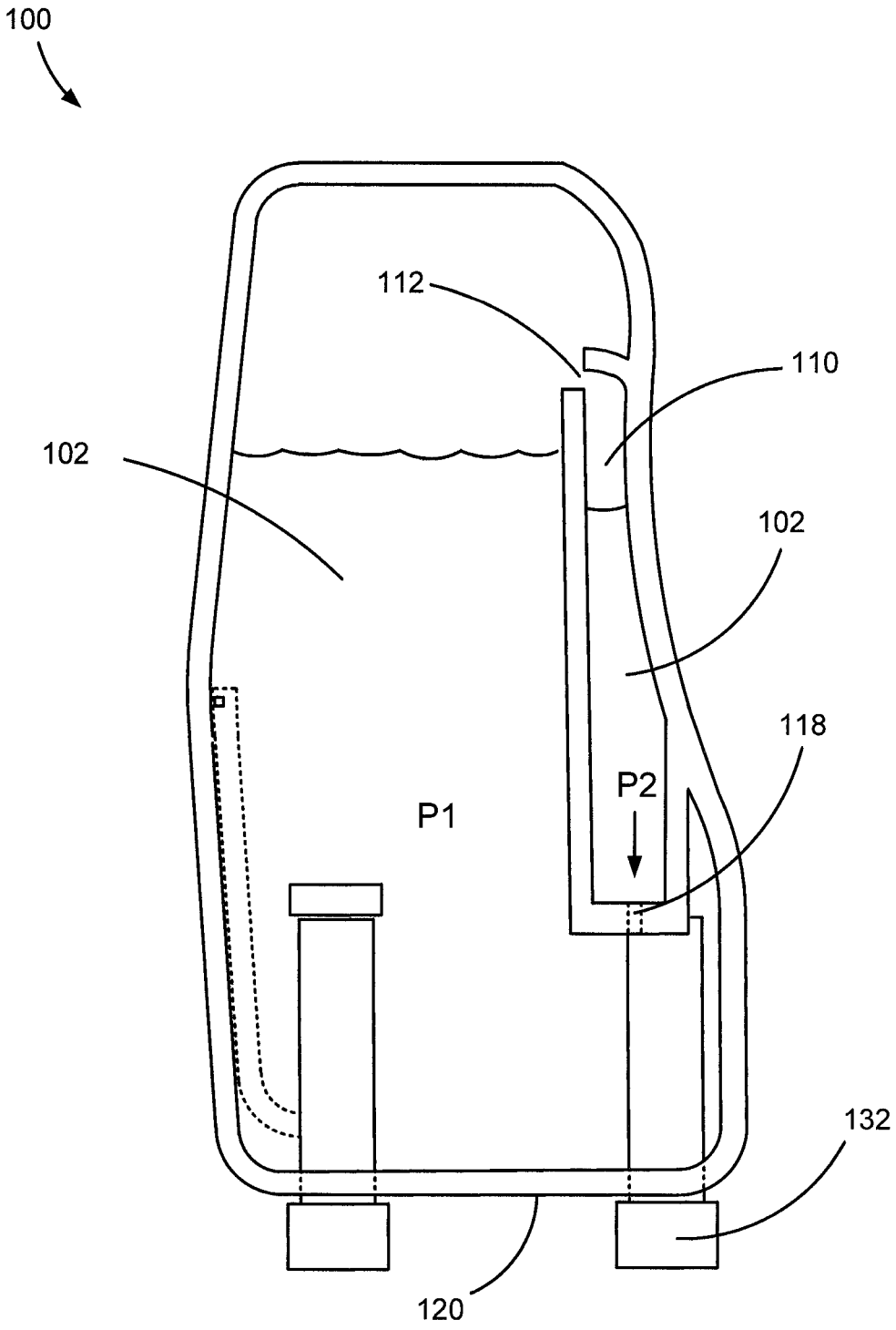
FIG. 4 is a diagrammatic view of a fluid container of FIG. 3 showing the fluid container oriented with the front side faced downwards.

FIG. 4 depicts the container 100 of FIG. 3 oriented with the front side 120 facing downwards. FIG. 4 shows a volume of fluid 102 inside the air chamber 110 exerting a pressure P2 on the vent hole 118. The air chamber 110 is configured to limit the volume of fluid 102 that could be accommodated therein to keep the pressure P2 lower compared to the pressure P1 in the fluid chamber 106. With a minimal volume of fluid 102 inside the air chamber 110, pressure P2 is kept lower thus avoiding fluid leaks 102D in the vent 132.

Figure 5:
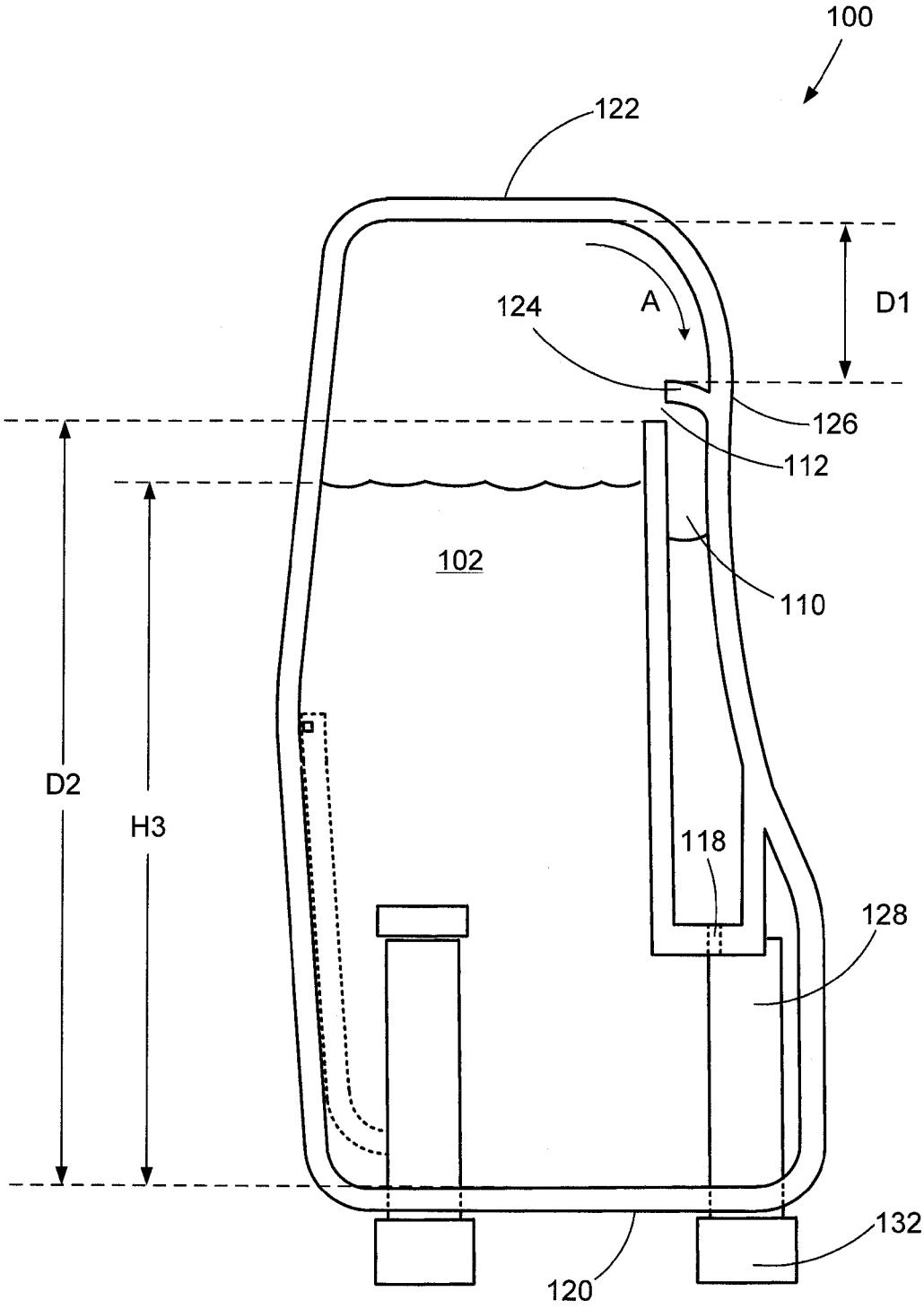
FIG. 5 is a diagrammatic view of a fluid container of FIG. 4 showing in detail the height of the fluid and the location of the air inlet.

FIG. 5 depicts in detail the fourth example embodiment mentioned above. The sidewall 124 is disposed at a distance D1 from the back side 122 and extends substantially transverse from the upper wall 126. The sidewall 124 blocks any flow of fluid 102 towards the direction A to prevent sudden rush of fluid 102 towards the vent hole 118 during movement and reorientation of the container 100.

FIG. 5 also shows a fifth example embodiment of the present invention where the air inlet 112 is disposed at a distance D2 from the front side 120. D2 is greater than the height H3 of the fluid 102 at any given time when the container 100 is oriented with the front side 120 facing downwards. The location of the air inlet 112 in the present example embodiment minimizes the instances when the air chamber 110 is fully filled with fluid 102 during movement and reorientation of the container 100 thus keeping the pressure P2 of FIG. 4 low.

Figure 6:
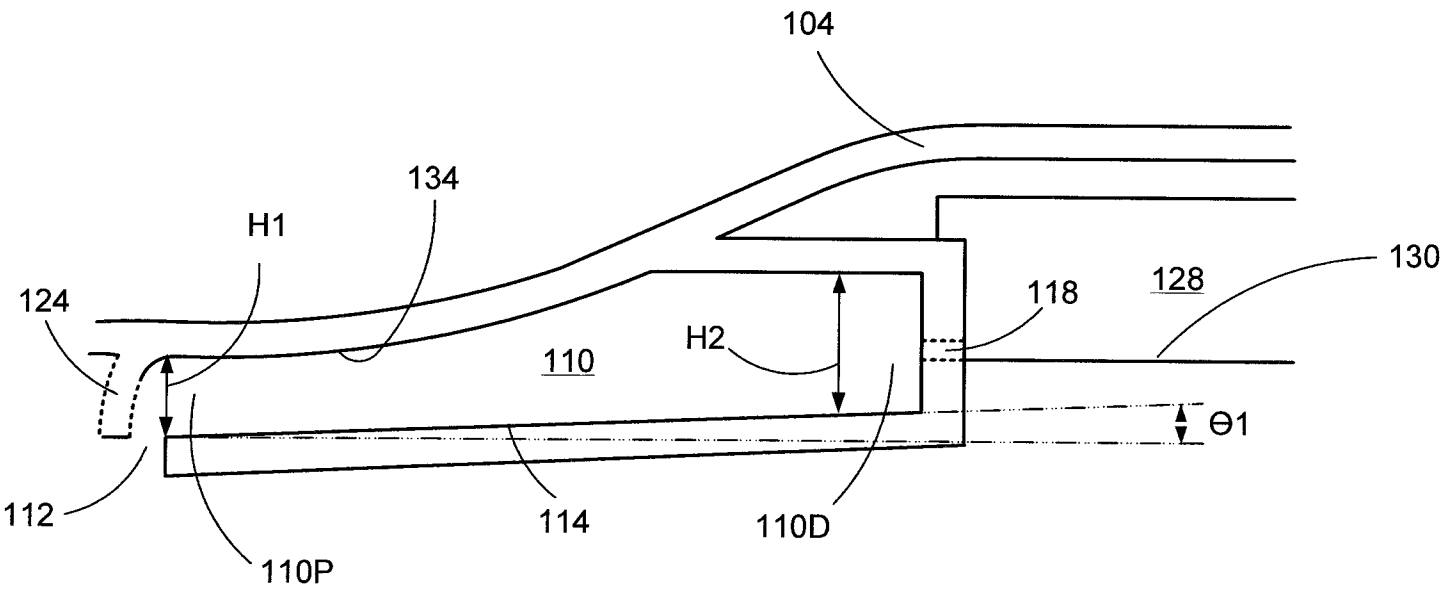
FIG. 6 is a diagrammatic detailed view of the air chamber according to the present disclosure.

FIG. 6 shows a much detailed view of the vent system. The bottom surface 114 inclines from the air inlet 112 by an angle $\Theta$1 to enable fluid 102 from the air chamber 110 to flow back to the fluid chamber 106. The distance H1 between the ceiling 134 and the bottom surface 114 at the proximate end 110P of the air chamber 110 is also shown to be lesser than the distance H2 at the distal end. With this configuration, the air chamber 110 has a narrower width at the proximate end 110P than at the distal end 110D resulting to lesser volume of fluid 102 inside the air chamber 110. As mentioned above, lesser volume equates to lower pressure P2 acting on the vent hole 118. With less pressure P2 acting on the vent hole 118, fluid leaks 102D is prevented.

FIG. 6 also shows a sixth example embodiment of the present invention. In this example embodiment, a bottom surface 130 of the air exit channel 128 substantially aligns with the vent hole 118 to allow fluid 102 trapped in the air exit channel 128 to drain back to the air chamber 110 and into the fluid chamber 106.

The foregoing illustrates various aspects of the present disclosure. It is not intended to be exhaustive. Rather, it is chosen to provide the best illustration of the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A container to hold a volume of fluid, comprising:

a housing defining an interior, wherein the housing includes a fluid chamber disposed at a lower portion of the housing to hold the volume of fluid;

a fluid exit port fluidly connected to the fluid chamber to deliver outside the housing the fluid from the interior; and a vent system disposed at an upper portion of the interior adjacent to the fluid chamber to vent air from the interior to atmosphere, wherein the vent system includes an air chamber in the interior in fluid communication with the fluid chamber through an air inlet at a proximate end of the air chamber and having a ceiling and a bottom surface with a first vertical distance to the ceiling at a distal end of the air chamber and a second, lesser vertical distance to the ceiling at the proximate end of the air chamber; and at least one vent hole disposed at the distal end to receive air from the air chamber and deliver the air to atmosphere outside the housing, wherein the bottom surface of the air chamber is inclined from the air inlet upwardly toward the at least one vent hole.

2. The container of claim 1, wherein the bottom surface is inclined between the air inlet and the at least one vent hole of the air chamber at an angle of about 2 degrees to about 7 degrees.

3. The container of claim 1, wherein the air chamber is centrally disposed between a front and back of the housing.

4. The container of claim 3, wherein the air chamber includes a side wall extending substantially transverse from an upper wall of the housing and at a distance from the back of the housing to prevent fluid from rushing directly towards the at least one vent hole during movement of the container.

5. The container of claim 4, wherein the air inlet is disposed on a terminal end of the bottom surface.

6. The container of claim 5, wherein the air inlet is a rectangular opening extending across a width of the bottom surface.

7. The container of claim 1, wherein a distance of the air inlet from a front side of the container is greater than a height of the fluid when the container is positioned with the front side facing downwards.

8. The container of claim 1, wherein the at least one vent hole aligns with a bottom surface of an air exit channel to allow fluid trapped inside the air exit channel to drain back toward the air chamber and into the fluid chamber.

9. The container of claim 1, wherein the vent system further includes a vent disposed on a front side of the container.

10. The container of claim 1, wherein the ceiling extends from the proximate end towards the distal end of the air chamber, and wherein the ceiling is higher at the distal end than at the proximate end.

11. A vent system disposed in a housing of a fluid container of a micro-fluid imaging device, comprising:

an air chamber in an interior of the housing in fluid communication with the fluid chamber through an air inlet at a proximate end of the air chamber and having a ceiling and a bottom surface with a first vertical distance to the ceiling at a distal end of the air chamber and a second, lesser vertical distance to the ceiling at the proximate end of the air chamber;

at least one vent hole disposed on the distal end of the air chamber to receive air from the air chamber and deliver the air to atmosphere outside the housing;

an air exit channel in fluid communication with the air chamber through the at least one vent hole to collect air from the air chamber; and a vent disposed outside the housing to vent air from the air exit channel to the atmosphere, wherein the bottom surface of the air chamber is inclined from the air inlet upwardly toward the at least one vent hole.

12. The vent system of claim 11, wherein the bottom surface is inclined between the air inlet and the at least one vent hole of the air chamber at an angle of about 2 degrees to about 7 degrees.

13. The vent system of claim 11, wherein the air chamber is centrally disposed between a front and back of the housing.

14. The vent system of claim 13, wherein the air chamber includes a side wall extending substantially transverse from an upper wall of the housing and at a distance from the back of the housing to prevent fluid from rushing directly towards the at least one vent hole during movement of the container.

15. The vent system of claim 14, wherein the air inlet is disposed on a terminal end of the bottom surface.

16. The vent system of claim 11, wherein a distance of the air inlet from a front side of the housing is greater than a height of the fluid when the container is positioned with the front side facing downwards.

17. The vent system of claim 11, wherein the at least one vent hole aligns with a bottom surface of the air exit channel to allow fluid trapped inside the air exit channel to drain back toward the air chamber and into the fluid chamber.

18. The vent system of claim 11, wherein the vent is disposed on a front side of the container.

19. The vent system of claim 11, wherein the ceiling extends from the proximate end towards the distal end of the air chamber, and wherein the ceiling is higher at the distal end is than at the proximate end.

* * * * *